US005107609A

United States Patent [19]

Sartor

[11] Patent Number: 5,107,609

[45] Date of Patent: Apr. 28, 1992

[54] SKI BOOT WITH IMPROVED FIT

[75] Inventor: Mariano Sartor, Montebelluna, Italy

[73] Assignee: Nordica S.p.A., Montebelluna, Italy

[21] Appl. No.: 641,316

[22] Filed: Jan. 14, 1991

Related U.S. Application Data

[63] Continuation of Ser. No. 349,197, May 8, 1989, abandoned.

[30] Foreign Application Priority Data

May 20, 1988 [IT] Italy ..... 82550 A/88

[51] Int. Cl.[5] ..... A43B 5/04

[52] U.S. Cl. ..... 36/120; 36/50

[56] References Cited

U.S. PATENT DOCUMENTS

| | | | |
|---|---|---|---|
| 3,665,619 | 5/1972 | Gray | 36/118 |
| 3,803,730 | 4/1974 | Hanson et al. | 36/117 |
| 4,203,235 | 5/1980 | Van Pelt, Jr. | 36/118 |
| 4,575,957 | 3/1986 | Petrini | 36/121 |
| 4,633,599 | 1/1987 | Morell et al. | 36/50 |
| 4,680,878 | 7/1987 | Pozzobon et al. | 36/117 |
| 4,711,042 | 12/1987 | Morell et al. | 36/50 |
| 4,765,069 | 8/1988 | Baggio et al. | 36/50 |
| 4,839,973 | 6/1989 | Dodge | 36/121 |

FOREIGN PATENT DOCUMENTS

| | | | |
|---|---|---|---|
| 120267 | 10/1984 | European Pat. Off. | 36/117 |
| 191368 | 8/1986 | European Pat. Off. | 36/117 |
| 229638 | 7/1987 | European Pat. Off. | 36/117 |

*Primary Examiner*—Paul T. Sewell
*Assistant Examiner*—BethAnne C. Cicconi
*Attorney, Agent, or Firm*—Guido Modiano; Albert Josif

[57] ABSTRACT

The present invention relates to a ski boot with improved fit, comprising a shell to which at least one quarter is articulated. The peculiarity of the invention resides in that it comprises a movable flap which is arranged at a preset opening provided on the at least one quarter and rearwardly embraces the skier's leg. Means for selecting the inclination of the flap with respect to the at least one quarter are associated with the flap itself and can be actuated by the skier.

4 Claims, 2 Drawing Sheets

SKI BOOT WITH IMPROVED FIT

This is a continuation application of application Ser. No. 07/349,197 filed on May 8, 1989, now abandoned.

BACKGROUND OF THE INVENTION

The present invention relates to a ski boot with improved fit.

The problem is currently felt of providing a boot which allows the skier to walk correctly after he has stopped skiing.

This problem adds to that of keeping the foot correctly secured inside the boot; the mere opening of the quarter or quarters, in fact, allows snow to enter and also produces an unpleasant play of the foot inside the boot.

At the same time, it is important to maintain a good rear support for the leg both during skiing and while walking.

In view of these problems, many kinds of ski boots are currently known which partially and individually solve the above described problems.

A monolithic rear-entry boot is in fact known which allows to vary the inclination of the leg by acting on adapted levers, which however also adjust the degree of securing of said leg.

A U.S. Pat. No. 4,203,235 is also known which describes a boot which has a rear support adjuster which besides having the disadvantage of acting only on the part of the leg which is outside the boot had a single degree of adjustment which can be set by inserting an adapted wedge.

In order to vary the inclination it is therefore necessary to remove said wedge and/or replace it with others of different sizes; such an operation is undoubtedly not easy, and the skier must furthermore have a plurality of wedges easily available.

A ski boot particularly for mountain skiing is also known in which the rear quarter is rearwardly provided with a notch in which the edges can partially overlap and be moved closer by using a band which can be tensioned by means of a lever: even in this case, however, there is a dependency between the degree of securing of the quarter and the inclination which can be set for said quarter by acting on said lever.

As a partial solution to this disadvantage, the same Applicant filed Jan. 5, 1987 U.S. Ser. No. 07/000,785 (European Patent No. 229,638) claiming a support adjuster for ski boot quarters, the peculiarity whereof resides in that it comprises a shaped body which embraces at least one portion of the skier's leg and is supported at the upper end of the quarter of a boot, removable locking means for positioning said shaped body with respect to the quarter being furthermore provided.

Said support adjuster, however, has a rather complicated structure from the point of view of production which increases its overall cost, and its adjustment is not very easy since the skier must act directly on the shaped body to incline it and the backward motion of said body must occur while keeping constantly pressed a release button which constitutes said removable locking means.

SUMMARY OF THE INVENTION

The aim of the present invention is therefore to eliminate the disadvantages described above in known types by providing a ski boot which allows to vary the possible position of the leg by varying the inclination which can be obtained thereby in the direction of the rear region of said boot, regardless of the securing degree of the quarter.

Within the scope of the above described aim, an important object is to provide a boot which allows to walk easily once said boot has been released from the ski, allowing the skier to keep an upright position during this phase.

Another important object is to provide a boot which allows to easily insert the foot, maintaining a good rear support of the leg.

Not least object is to provide a ski boot which associates the above described characteristics with that of being safe and reliable in use, of being structurally simple and of having a low cost, said boot being producible with conventional machines and systems.

This aim, these objects and others which will become apparent hereinafter are achieved by a ski boot with improved fit, comprising a shell to which at least one quarter is articulated, characterized in that it comprises a movable flap which is arranged at an adapted opening provided on said at least one quarter and rearwardly embraces the skier's leg, means being associated with said flap, said means being actuatable by the skier and cooperating with at least one traction element to select its inclination with respect to said at least one quarter.

Said flap is advantageously obtained by molding from said shell or said at least one quarter or is connected to means for articulating it to said shell or to said at least one quarter.

Said means for selecting the inclination of said flap with respect to said at least one quarter are conveniently constituted by a tensioning and/or adjustment element, such as a vertical lever or a circular winding device which tensions at least one traction element such as a cable.

BRIEF DESCRIPTION OF THE DRAWINGS

Further characteristics and advantages will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
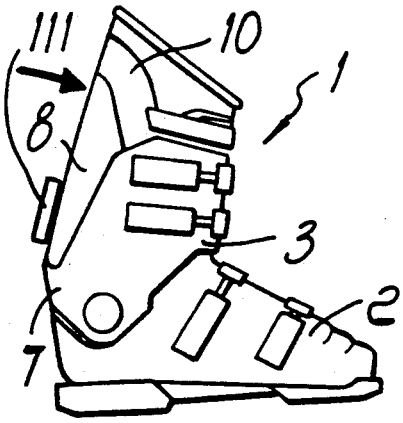
FIGS. 1 and 2 are side views of a ski boot to which the movable flap is applied, in two different positions obtainable by said flap.

With reference to the above described figures, the reference numeral 1 indicates a ski boot, particularly of the front-entry type, constituted by a shell 2 to which a quarter 3 is articulated. An inner shoe 10 is insertable inside the shell 2 and quarter 3. The quarter 3 is closed about the inner shoe 10 by adapted known securing means such as for example levers 18.

Said quarter has, at its rear region, an opening 4 which affects almost all of its longitudinal extension starting from its upper perimetric edge 5 to its lower perimetric edge 5*a* which overlies the heel region 6 of the shell 2.

A lower bridge 7 of the outer 3 is thus defined at the heel of the shell 2 region 6, and the end of a flap 8 which rearwardly embraces the calf of the skier is articulated to said bridge and is arranged at the opening 4 provided on said quarter. As mentioned above and as seen in the figures, the opening 4 provided in the quarter 3 has a longitudinal extension which affects nearly all of the longitudinal extension of the quarter. Thus, the lower bridge 7 of the quarter 3 has a width which is significantly smaller than the longitudinal extension of the opening 4. Furthermore, since the opening 4 extends all the way down to the bridge 7 which is arranged at the heel region 6, the flap 8 is allowed to pivot in the opening 4 around an axis which is defined at such heel region 6.

Figure 3:
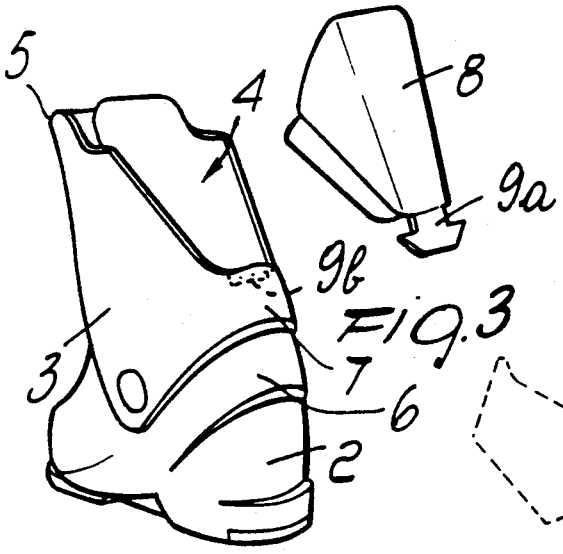
FIG. 3 is a rear isometric view of the connection between said flap and said quarter according to a first embodiment.
Figure 4:
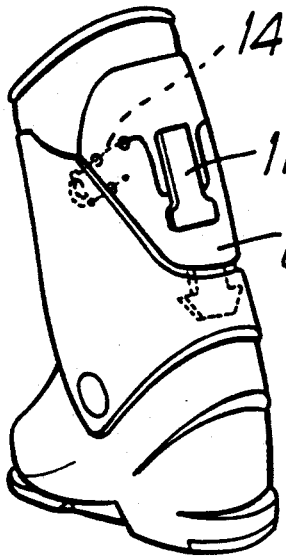
FIG. 4 is a view of a first embodiment of the means for selecting the inclination of said flap with respect to said quarter.

The flap 8 is advantageously fixed by means of a lower tooth 9*a* which fits snugly in a slot 9*b* provided in the lower bridge of the quarter 3, as illustrated in FIGS. 3 and 4.

Figure 6:
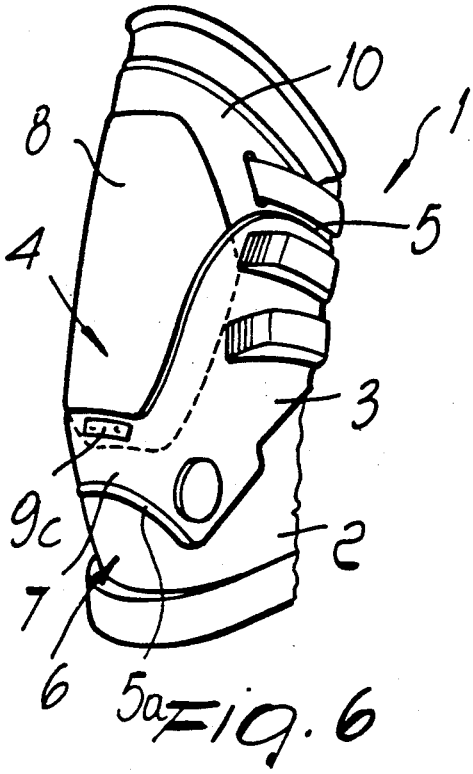
FIG. 6 is a view of a boot fitted with a flap according to a further embodiment.

Said flap 8 may also be articulated to the bridge 7 by means of articulation means constituted by an adapted plate 9*c* (as illustrated in FIG. 6) or possibly by means of an adapted pivoting pin arranged transversely to said quarter 3.

By virtue of the presence of the plate 9 arranged transversely to the quarter, it is possible to move said flap so as to make it approach the inner shoe 10 of the boot or move away therefrom.

Figure 7:
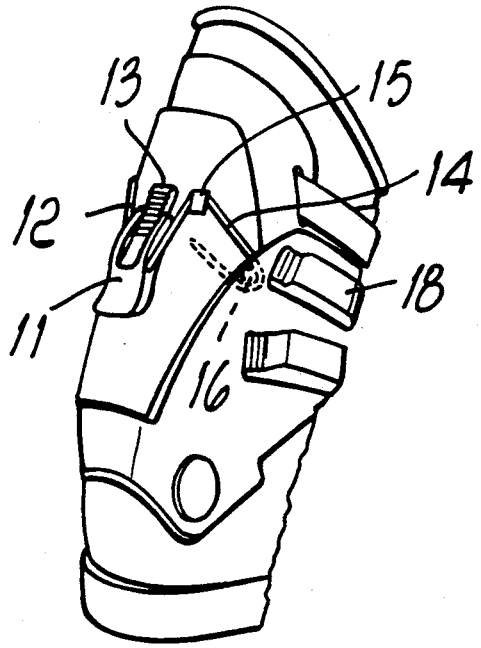
FIG. 7 is a view of a boot according to another embodiment.

Means for selecting the inclination of said flap 8 with respect to the quarter 3 are furthermore associated with the flap itself and can be constituted for example by a vertical lever 11, illustrated in FIG. 7, which has a pivot 12 interacting with a rack 13 arranged longitudinally to the flap 8; as an alternative, the rack can be provided on the lever.

Adapted traction elements, such as for example cables 14, are associated laterally to the vertical lever 11 and interact with a first return element 15 arranged laterally to the flap 8 and then with a second return element 16 which protrudes internally and laterally to the front quarter 3, and the cables 14 are then again associated with the flap 8.

Figure 5:
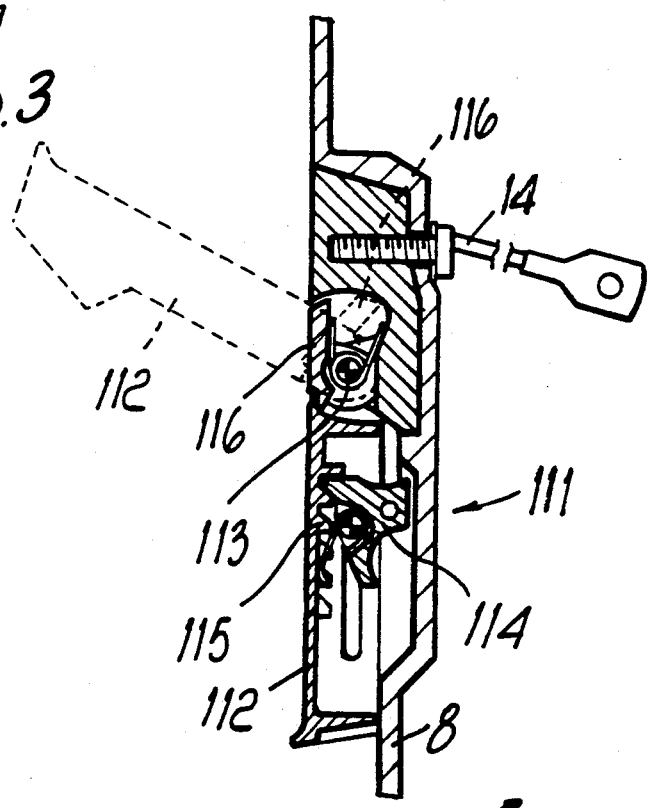
FIG. 5 is a sectional lateral elevation view of the inclination selection means, constituted by a vertical lever.

The inclination selection means may also be constituted by a lever 111, of the kind illustrated in FIG. 5, comprising a lever arm 112 which is pivoted at the pivot 113 and acts on a cable 14 by means of a slider 114.

The tension of the cable 14 is adjusted, when the arm 112 is open as illustrated in broken lines in FIG. 5, by adjusting the position of the slider 114 with respect to the teeth 115 of the arm 112.

A cover 116 is pivoted to the pivot 113 and allows a greater rotation of the arm 112 during opening, returning partially within the lever body, as illustrated in broken lines in the figure.

Figure 8:
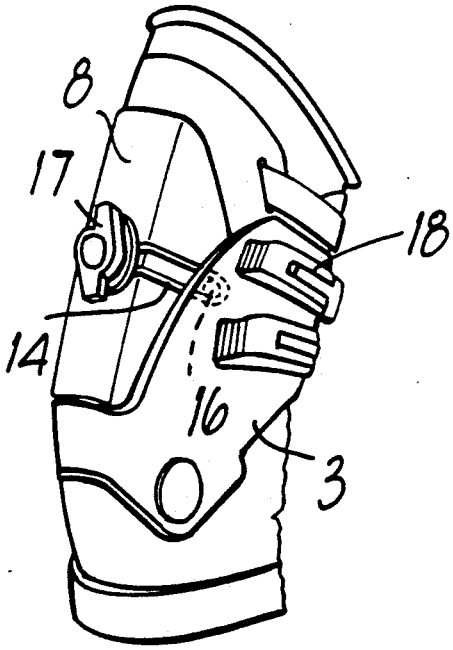
FIG. 8 is a view of a second embodiment of said means for selecting the inclination of said flap.

As an alternative to the vertical lever 11 and 111, a circular winding device 17 can be used; as shown in FIG. 8 said device is rotatably associated rearwardly to the flap 8 and actuates an adapted pulley to wind up one or more cables 14 which laterally affect the flap 8, then an adapted second return element 16 which protrudes internally and laterally to the quarter 3, and the cables 14 are then again associated with the flap 8.

The cables 14 can thus be rapidly wound, imparting a different inclination to the flap 8 with respect to the quarter 3, which is closed by means of adapted known devices such as for example levers 18.

This allows an adjustment which is independent from the degree of securing of the quarter.

Figure 2:
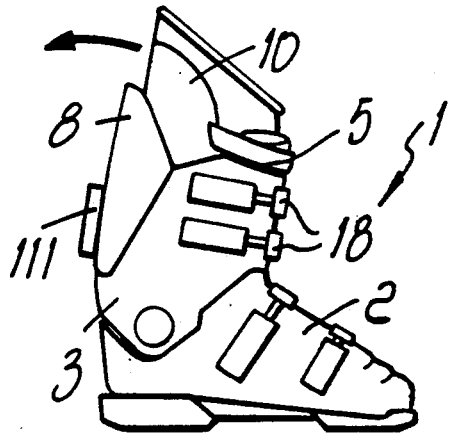

By loosening the degree of tensioning of the cables 14, the flap 8 can be arranged in the reclined condition illustrated in FIG. 2; in this condition it is possible to maintain an upright posture while walking, and it is easier to insert the foot in the boot.

The use of a vertical lever 11 or 111 furthermore allows to memorize the selected degree of inclination, and it is therefore sufficient to close said lever by inclining the flap by the previously selected amount to pass from the walking condition to the skiing condition.

It has thus been observed that the invention achieves the intended aim and objects, a ski boot having been provided in which it is possible to vary the position of the leg regardless of the degree of securing of the quarter.

The skier can just as easily start walking after performing a simple operation, keeping his leg in an upright position, i.e. approximately perpendicular to the ground support plane.

The boot also provides a good rear support for the leg, allowing the skier to easily insert his foot.

The use of means such as vertical levers or circular devices reduces the effort required to incline the flap without furthermore pressing at the calf while winding the cables. The lateral wings of the quarter 3 are in fact not subject, at the opening 4, to any deformation which causes said wings to approach one another.

The invention is naturally susceptible to numerous modifications and variations, all of which are within the scope of the same inventive concept.

Figure 9:
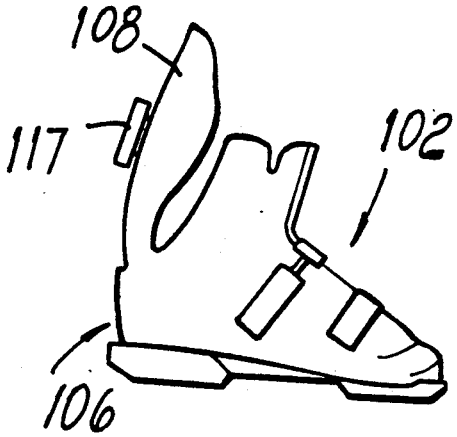
FIG. 9 is a lateral view of a shell in which said flap is provided during molding.

Thus for example FIG. 9 illustrates a shell 102 which has a flap 108 at the rear region overlying the heel region 106; said flap 108 protrudes on the opposite side with respect to the sole and embraces the region of the skier's calf.

A means for selecting said flap's inclination with respect to the quarter is advantageously rearwardly associated with said flap 108; said flap is constituted by one of the above defined systems, comprising, for example, a knob 117.

Figure 10:
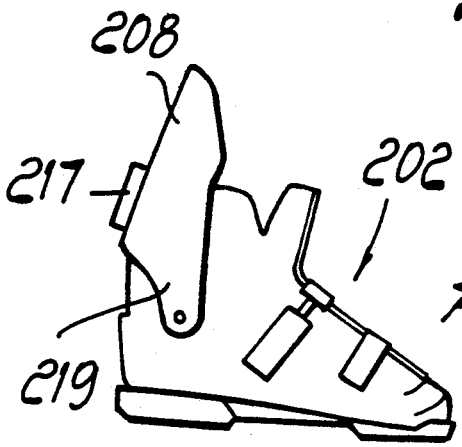
FIG. 10 is a side view of a shell in which said flap is articulated laterally to said shell.

FIG. 10 illustrates a further embodiment, in which the wings 219 of a flap 208 which embraces the skier's heel region are laterally articulated to a shell 202.

In this case, too, means for selecting the inclination of the flap with respect to the quarter are advantageously associated with said flap 208. FIGS. 1–10 have shown in particular a front-entry type ski boot, but a rear-entry type boot can also be used which would be within the scope of the inventive concept; the inclination of the movable flap provided by the various inclination selection means is obtained independently from the securing means of the quarter, whether the boot be of a rear-entry type or of a front-entry type.

The materials and the dimensions constituting the individual components of the boot may naturally be the most pertinent according to the specific requirements.

I claim:

1. Ski boot of the front-entry type with improved fit, comprising a shell, at least one quarter, securing means, and an inner shoe, said at least one quarter being articulated to said shell, said inner shoe being inserted inside said shell with said at least one quarter articulated thereto, said securing means being associated with said at least one quarter to close said at least one quarter about said inner shoe, thereby securing said inner shoe inside said shell with said at least one quarter articulated thereto, said at least one quarter comprising an upper perimetric edge, a lower perimetric edge, and a lower bridge, said shell comprising a heel region, said lower perimetric edge of said at least one quarter being arranges at said heel region of said shell, said lower bridge of said at least one quarter being arranged at and embracing said heel region of said shell above said lower perimetric edge of said at least one quarter, wherein an opening is provided in said at least one quarter, said opening of said at least one quarter defining a longitudinal extension which extends longitudinally and rearwardly from said upper perimetric edge to said lower bridge, said lower bridge having a width which is significantly smaller in size than said longitudinal extension of said opening, and thereby said longitudinal extension of said opening extending from said upper perimetric edge of said at least one quarter to said heel region, and wherein said ski boot further comprises a movable flap for embracing a user's lower leg calf portion and inclination selection means, said movable flap being arranged at said opening of said at least one quarter, said movable flap being pivotable in said opening around an axis defined at said heel region, said inclination selection means being associated with said movable flap to select an inclination of said movable flap with respect to said at least one quarter.

2. Ski boots of the front-entry type with improved fit, comprising a shell, at least one quarter, securing means, and an inner shoe, said at least one quarter being articulated to said shell, said inner shoe being inserted inside said shell with said at least one quarter articulated thereto, said securing means being associated with said at least one quarter to close said at least one quarter about said inner shoe, thereby securing said inner shoe inside said shell with said at least one quarter articulated thereto, said at least one quarter comprising an upper perimetric edge, a lower perimetric edge, and a lower bridge, said shell comprising a heel region, said lower perimetric edge of said at least one quarter being arranged at said heel region of said shell, said lower bridge of said at least one quarter being arranged at and embracing said heel region of said shell above said lower perimetric edge of said at least one quarter, wherein an opening is provided in said at least one quarter, said opening of said at least one quarter defining a longitudinal extension which extends longitudinally and rearwardly from said upper perimetric edge to said lower bridge, said lower bridge having a width which is significantly smaller in size than said longitudinal extension of said opening, and thereby said longitudinal extension of said opening extending from said upper perimetric edge of said at least one quarter to said heel region, and wherein said ski boot further comprises a movable flap for embracing a user's lower leg calf portion and inclination selection means, said movable flap being arranged at said opening of said at least one quarter, said movable flap being pivotable in said opening around an axis defined at said heel region, said inclination selection means being associated with said movable flap to select an inclination of said movable flap with respect to said at least one quarter, said inclination selection means comprising a lever arm pivoted to said movable flap and a cable element, said cable element being interconnected between said at least one quarter and a slider element which is slidable on said lever arm, said cable element further being slidably accommodated in return elements provided on said movable flap, an inside portion of said lever arm which faces said movable flap being provided with a set of teeth, said slider element being provided with a tooth which is lockably arrangeable in one tooth of said set of teeth to thereby lockably position said slider element with respect to said lever arm.

3. Ski boot according to claim 2, wherein said lever arm is pivoted to said movable flap around a pivot, said inclination selection means further comprising a cover element which is also pivoted around said pivot to thereby allow a greater rotation of said lever arm about said pivot.

4. Ski boot of the the front-entry type with improved fit, comprising a shell, at least one quarter, securing means, and an inner shoe, said at least one quarter being articulated to said shell, said inner shoe being inserted inside said shell with said at least one quarter articulated thereto, said securing means being associated with said at least one quarter to close said at least one quarter about said inner shoe, thereby securing said inner shoe inside said shell with said at least one quarter articulated thereto, said at least one quarter comprising an upper perimetric edge, a lower perimetric edge, and a lower bridge, said shell comprising a heel region, said lower perimetric edge of said at least one quarter being arranged at said heel region of said shell, said lower bridge of said at least one quarter being arranged at and embracing said heel region of said shell above said lower perimetric edge of said at least one quarter, wherein an opening is provided in said at least one quarter, said opening of said at least one quarter defining a longitudinal extension which extends longitudinally and rearwardly from said upper perimetric edge to said lower bridge, said lower bridge having a width which is significantly smaller in size than said longitudinal extension of said opening, and thereby said longitudinal extension of said opening extending from said upper perimetric edge of said at least one quarter to said heel region, and wherein said ski boot further comprises a movable flap for embracing a user's lower leg calf portion and inclination selection means, said movable flap being arranged at said opening of said at least one quarter, said movable flap being pivotable in said opening around an axis defined at said heel region, said inclination selection means being associated with said movable flap to select an inclination of said movable flap with respect to said at least one quarter, said movable flap defining a lower end which is connected directly to said lower bridge of said at least one quarter, and thereby said movable flap being pivotable around an axis defined at said heel region.

* * * * *